United States Patent [19]

Kobayashi

[11] 4,412,124

[45] Oct. 25, 1983

[54] ELECTRODE UNIT FOR ELECTRICALLY HEATING UNDERGROUND HYDROCARBON DEPOSITS

[75] Inventor: Toshiyuki Kobayashi, Hyogo, Japan

[73] Assignee: Mitsubishi Denki Kabushiki Kaisha, Hyogo, Japan

[21] Appl. No.: 269,180

[22] Filed: Jun. 2, 1981

[30] Foreign Application Priority Data

| | | | |
|---|---|---|---|
| Jun. 3, 1980 | [JP] | Japan | 55-75208 |
| Jun. 3, 1980 | [JP] | Japan | 55-75209 |
| Jun. 3, 1980 | [JP] | Japan | 55-75210 |
| Jun. 3, 1980 | [JP] | Japan | 55-75212 |
| Jun. 3, 1980 | [JP] | Japan | 55-75213 |
| Jun. 3, 1980 | [JP] | Japan | 55-75214 |

[51] Int. Cl.[3] ..... H05B 3/03; E21B 36/00; E21B 43/24; H01R 4/60

[52] U.S. Cl. ..... 219/277; 174/6; 166/60; 166/248; 219/288; 219/289; 219/278

[58] Field of Search ..... 219/277, 278, 288, 289; 166/248, 272, 302, 60, 65 R; 174/6, 7; 339/15, 16 R, 16 C, 16 RC

[56] References Cited

U.S. PATENT DOCUMENTS

| | | | |
|---|---|---|---|
| 3,605,888 | 9/1971 | Crowson et al. | 166/248 |
| 3,620,300 | 11/1971 | Crowson | 166/248 |
| 4,301,865 | 11/1981 | Kasevich | 166/248 |
| 4,320,801 | 3/1982 | Rowland | 166/248 |

*Primary Examiner*—M. H. Paschall
*Assistant Examiner*—Teresa J. Walberg
*Attorney, Agent, or Firm*—Sughrue, Mion, Zinn, Macpeak, and Seas

[57] ABSTRACT

An electrode unit for electrically heating underground hydrocarbon deposits having a main conduit pipe assembly, a cylindrical water pipe and an electrical conductor arranged coaxially with the electrical conductor disposed between the water pipe and the main conduit pipe assembly. The spaces between the main conduit pipe assembly and the cylindrical water pipe are filled with a solid insulating material, wherein it is not necessary to recirculate cooling oil through the assembly. Connectors are disposed for joining ends of adjacent main conduit pipe assemblies, ends of adjacent water pipes and electrical conductors. Preferably, the electrical conductor is made of a material such as a metal mesh which can stretch longitudinally.

11 Claims, 13 Drawing Figures

ELECTRODE UNIT FOR ELECTRICALLY HEATING UNDERGROUND HYDROCARBON DEPOSITS

BACKGROUND OF THE INVENTION

The present invention relates to electrode units for electrically heating underground hydrocarbon deposits. More particularly, the invention relates to an electrode unit which, if hydrocarbons having a high viscosity and low fluidity are to be extracted, is used to feed electric current to the ground to heat the hydrocarbon deposit to increase the fluidity thereof.

The term "hydrocarbons" as herein used is intended to include petroleum, oil, bitumen contained in oil sand or tar sand and kerogen contained in oil shale. For simplification in description, these hydrocarbons will be referred to merely as "oil." Furthermore, the term "producing" or "production" as herein used is intended to mean extraction of fluid oil out of a well by self-spouting, pumping or fluid-transferring.

In the case where fluid oil is in the ground, a well is bored from the surface of the ground until it reaches the oil layer and fluid oil is extracted by spouting by the pressure of gas in the oil layer, by pumping fluid oil, or by injecting a liquid such as brine into one well under pressure so as to cause fluid oil to flow out of a second well. However, if the oil in the ground has a low fluidity, it is necessary to increase the fluidity of the oil prior to extraction through the well. In order to fluidize the oil, generally the oil is heated to decrease the viscosity thereof. Temperatures suitable for fluidizing oils depend on properties of the oil. In any event, it is necessary to heat the underground oil layer.

An oil layer can be heated by injecting hot water thereinto, by injecting steam at high temperature and at high pressure thereinto, by feeding electric current thereinto, by underground combustion in which an underground oil layer is ignited and then burnt by supplying air thereto, or by using explosives. The latter two methods are not practical because control thereof is considerably difficult.

For injecting hot water or steam at high temperature and high pressure, while an oil layer is heated to increase the fluidity of the oil, the oil fluidized can be spouted above the surface of the ground. However, if the oil layer includes a crack or a crevice having a high passage flow resistance, then the hot water or steam will flow through that part only. That is, the hot water or steam may not diffuse over the entire oil layer. Moreover, if an oil layer is hard and finely divided, the hot water or steam cannot diffuse therein, and accordingly it is difficult to heat the oil layer.

For heating an oil layer with electric current, a plurality of wells are bored in an oil layer, electrodes are disposed in the wells, and voltages are applied to the electrodes in the wells, so that the oil layer is heated through resistance heating. This technique is advantageous in that, even if an oil layer has cracks or is hard and finely divided, the oil layer can be heated in its entirety. However, it should be noted that the use of an additional device is required to extract the fluidized oil.

In order to increase the efficiency of production of oil, a method has been proposed in which, after an oil layer has been softened by heating by feeding electric current to an oil layer, the oil layer is maintained at an elevated temperature by injecting hot water or steam at high temperature and at high pressure to extract the fluidized oil. In order to efficiently heat the oil layer, it is essential to electrically insulate the electrode units in such a manner that the leakage of current to other than the oil layer is minimized. Furthermore, it is necessary that the electrode units be so designed that they cannot be damaged by the underground pressure, by steam used for heating, or the pressure or temperature of the injected hot water or steam.

In order to more concretely describe the electrode unit, the production of oil from oil sand will be described.

It has been confirmed that there are large deposits of oil or tar sand in the United States, Canada and Venezuela. The oil in the oil sand coexists with brine on the surface of a sand layer or between sand layers. Moreover, the oil in the deposits has a considerably high viscosity, and accordingly it is not fluid in the natural state. A part of the oil sand layer may be exposed in a canyon or on a river band. However, the larger part of the oil sand, having a thickness of several tens of meters, usually lies 200 to 500 m under the ground. Accordingly, from an economical point of view and from the standpoint of environmental protection, only limited amounts of oil sand can be dug from the ground and the oil separated therefrom. Therefore, it is a requirement to extract the oil directly from the underground deposit. If oil is produced from an oil sand layer lying at a short distance from the surface of the earth, the ground may cave in. Accordingly, it is desirable to extract oil only from oil sand layers lying more than 300 m underground.

FIG. 1 is an explanatory diagram illustrating a method of heating an oil sand layer with electric current. In FIG. 1, reference numerals 1 and 11 designate steel pipe casings, 2 and 12 insulators coupled to the casings 1 and 11, 3 and 13 electrodes coupled to the insulators 2 and 12, and 4 and 14 cables for supplying current to the electrodes 3 and 13. These elements form the electrode structure. Further in FIG. 1, reference numeral 5 designates a power source, 6 an oil sand layer, 7 current flowing between the electrodes 3 and 13, 8 the ground surface, 9 a layer above the oil sand layer (hereinafter referred to as "an overburden layer" when applicable), and 10 a layer beneath the oil sand layer (hereinafter referred to as "an oil sand lower layer").

When a voltage is applied across the electrodes 3 and 13 in the oil sand layer 6 through the cables 4 and 14 from the power source 5 located on the ground surface, current 7 flows between the electrodes 3 and 13 in an amount determined by the resistance of the oil sand layer 6, as a result of which the oil sand layer 6 is heated. In this operation, a part of the current 7 flows in the overburden layer 9 and the oil sand lower layer 10. However, since the insulators 2 and 12 are interposed between the electrodes 3 and 13, the amount of current flowing in the layers 9 and 10 is limited to a small value.

After the oil sand layer 6 has been heated sufficiently, the application of the voltage is suspended. Then, hot water or steam at high temperature and high pressure is injected into the oil sand layer 6 through one casing 1 of the electrode structure. As a result, hot water or steam together with oil flows out of the other casing 11. In general, the electrodes 3 and 13 have small holes therein in order to facilitate the flow of the hot water or steam.

FIG. 2 is a sectional view of a conventional electrode unit. In FIG. 2, reference numerals 3, 6 and 9 designate an electrode, an oil sand layer and an overburden layer, respectively, 15 a main conduit pipe assembly composed of a first conduit pipe 15*a* and a second conduit pipe 15*b*, 16 a first insulator disposed between the first and second conduit pipes 15*a* and 15*b* for insulating them from each other, 17 a second insulator which covers the first insulator 16 and surrounds the main conduit pipe assembly 15 near the first insulator 16, 18 a coupling through which the main conduit pipe assembly 15 is coupled to the electrode 3, 19 a partition member by which the electrode 3 is water-tightly separated from the main conduit pipe assembly 15, and 20 an electrical conductor which extends through the main conduit pipe assembly 15 and is connected through the partition member 15 to the electrode 3. Further in FIG. 2, reference numeral 21 designates an insulated oil supplying pipe which is arranged in the main conduit pipe assembly 15 and which opens near the partition member 19, 22 a water pipe which is also arranged in the main conduit pipe assembly 15 water-tightly penetrating the partition member and opening into the electrode 3, 23 cement filled in the gap between the main conduit pipe assembly 15 and a well 24 in which is inserted the electrode 3 with the cement being spread near the electrode, and 25 a blocking member for preventing salt water or hot water from rising through the gap between the cement 23 and the main conduit pipe assembly 15.

In heating the oil sand layer 6, brine is supplied into the water pipe 22 in the direction of the arrow A, and the salt water thus supplied flows through the holes 3*a* of the electrode 3 into the well as indicated by the arrows B thus filling the well. Then, insulating oil is supplied through the insulated oil supplying pipe 21 in the direction of the arrow C and is circulated in the direction of the arrow D. Under this condition, current is applied to heat the oil sand layer 6. After the oil sand layer has been heated for a certain period of time, the application of current is suspended, and instead of salt water, hot water is supplied through the water pipe 22 to heat the oil sand layer 6. Thereafter, similar to the case of FIG. 1, the oil sand layer is heated to cause oil to spout.

FIG. 3 is a cross sectional view of the above-described conventional electrode unit. As is apparent from FIG. 3, the electrical conductor 20, the insulated oil supplying pipe 21 and the water pipe 22 are not coaxial with the main conduit pipe assembly 15. Since the electrical conductor 20 is not coaxial with the main conduit pipe assembly 15, the impedance of the assembly 15 is higher than that which is provided when the conductor 20 is coaxial with the main conduit pipe assembly 15. In addition, as the insulated oil supplying pipe 22 and the water pipe 21 are arranged close to the electrical conductor 20, the impedance is further increased as a result of which the loss in current application is increased.

In the application of current to the oil sand layer 6, very little heat generated by the electrical conductor 20 is radiated, thereby leading to an increase in the temperature of the electrode structure. In addition, the conventional electrical conductor 20 is not flexible. Therefore, the electrical conductor 20 can be damaged due to the difference between the thermal expansion coefficients of the electrical conductor 20 and the main conduit pipe assembly 15 and it can be burnt as the temperature increases. Furthermore, the conventional electrode unit suffers from a drawback in that a temperature rise of elements adjacent to the electrode 3 cannot be prevented.

In the above-described conventional electrode unit, as is apparent from FIG. 3, the clearance between the water pipe 22 and the inner well of the main conduit pipe assembly 15 is small. The insulating oil is used to cool the electrical conductor. Therefore, when the oil sand layer 6 is heated by the hot water supplied through the water pipe, the insulating oil serves as a conductor for heat. Accordingly, a large amount of heat is conducted from the water pipe 22 through the insulating oil and the main conduit pipe assembly 15 into the overburden layer 9. In addition, it is necessary for the conventional electrode unit to have a device for maintaining the insulating oil at a low temperature. Thus, in the conventional electrode unit, the heat of the hot water is wasted by being conducted through the insulating oil and the main conduit pipe assembly into the ground, and furthermore a loss of heat occurs in cooling the insulating oil. That is, the conventional electrode unit has a low heating efficiency.

Moreover, the water pipe 22 involves a drawback in that, as in the case of the electrical conductor 20, it can easily be broken due to the difference between the thermal expansion coefficients of the water pipe 22 and the main conduit pipe assembly 15 when hot water is poured into the water pipe.

At a working site, the electrical conductor 20, the water pipe 22 and the insulated oil supplying pipe 21 are connected after which the main conduit pipe assembly 15 is connected. This operation is repeatedly carried out to assemble the electrode unit. Thus, the assembly of the electrode unit takes a great deal of time and labor.

SUMMARY OF THE INVENTION

Accordingly, an object of the present invention is to provide an electrical heating electrode unit which is free from the above-described various difficulties accompanying a conventional electrical heating electrode unit, which can be readily assembled, and has a high thermal efficiency.

This, as well as other objects of the invention, are met by an electrode unit for electrically heating underground hydrocarbon deposits including a main conduit pipe assembly, a cylindrical electrode, and a cylindrical water pipe. The main conduit pipe assembly, the electrode and the water pipe are arranged coaxially with the electrode being disposed between the water pipe and the main conduit pipe assembly. Between the electrode and the main conduit pipe assembly and between the electrode and the cylindrical water pipe is filled a solid insulating material such as glass wool, a molded material or inorganic solid powder. Also preferably, the electrical conductor is made of a metal mesh material which is stretchable to some extent.

BRIEF DESCRIPTION OF THE DRAWINGS

FIGS. 5–7 show another example of an electrode unit of the invention of which FIG. 5 is a cross-sectional view of the electrode unit, FIG. 6 is an explanatory diagram for a description of the connection of adjacent pipes, and FIG. 7 is an enlarged sectional view of the connecting point of the pipes;

DESCRIPTION OF THE PREFERRED EMBODIMENTS

Figure 1:
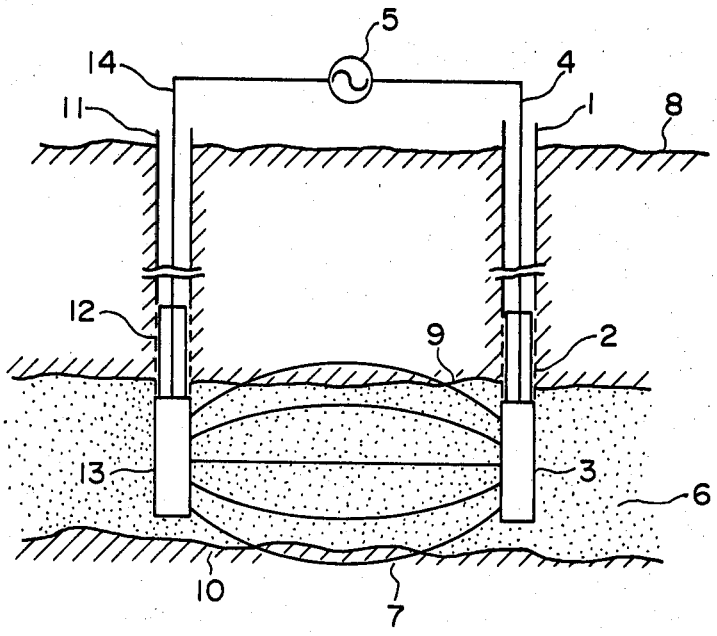
FIG. 1 is an explanatory diagram illustrating a prior art method of heating an oil sand layer with electrical current.
Figure 3:
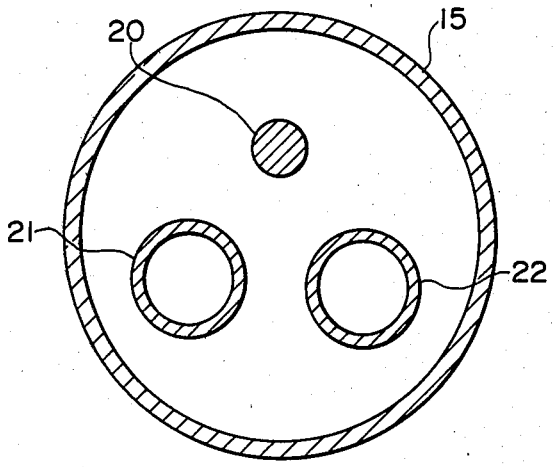
FIG. 3 is a cross-sectional view of the conventional electrode unit of FIG. 2 taken 90° with respect to the view of FIG. 2.
Figure 2:
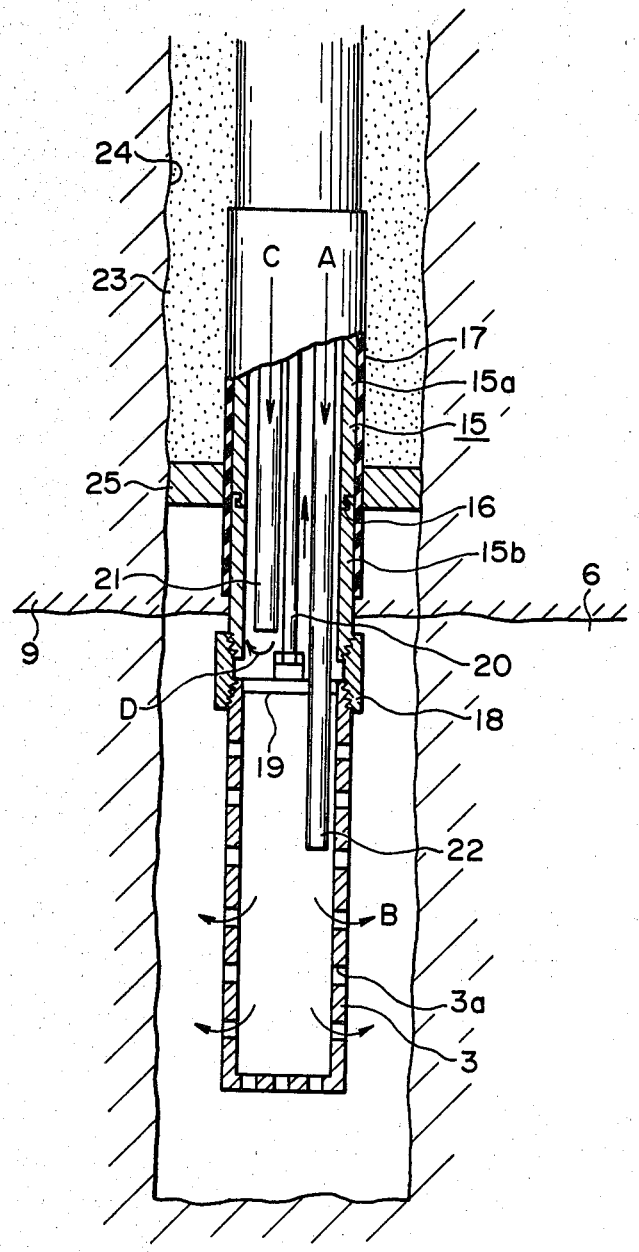
FIG. 2 is a cross-sectional view of a conventional electrode unit.
Figure 4:
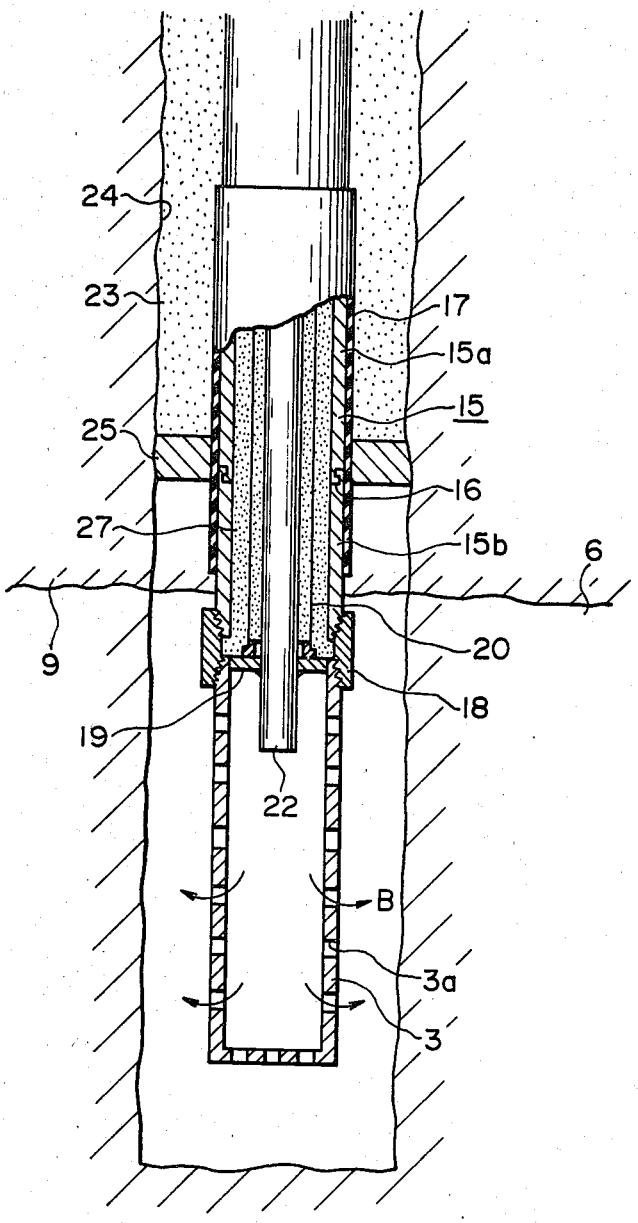
FIG. 4 is a cross-sectional view of a first preferred embodiment of an electrode unit of the invention.

FIG. 4 is a sectional view of a preferred embodiment of an electrical heating electrode unit constructed according to the present invention. In FIG. 4, reference numerals 3, 3*a*, 6, 9, 15 through 19, and 22 through 25 designate the same parts as those described with reference to the conventional electrode unit. Further in FIG. 4, reference numeral 20 designates an electrical conductor which is arranged coaxially with the main conduit pipe assembly 15, and 27 a solid heat insulating material filled in the gap between the inner wall of the main conduit pipe assembly 15 and the water pipe 22.

The procedure for spouting oil by heating the oil sand layer 6 with the electrode units thus constructed is similar to that described with reference to the conventional electrode unit. However, it should be noted that, in the electrode unit of the invention, unlike the conventional unit, it is unnecessary to circulate the insulating oil.

In the above-described example, the solid heat insulating material may be a fiberous material such as glass wool or a molded material. However, inorganic solid powder may be employed at a lower cost.

Figure 5:
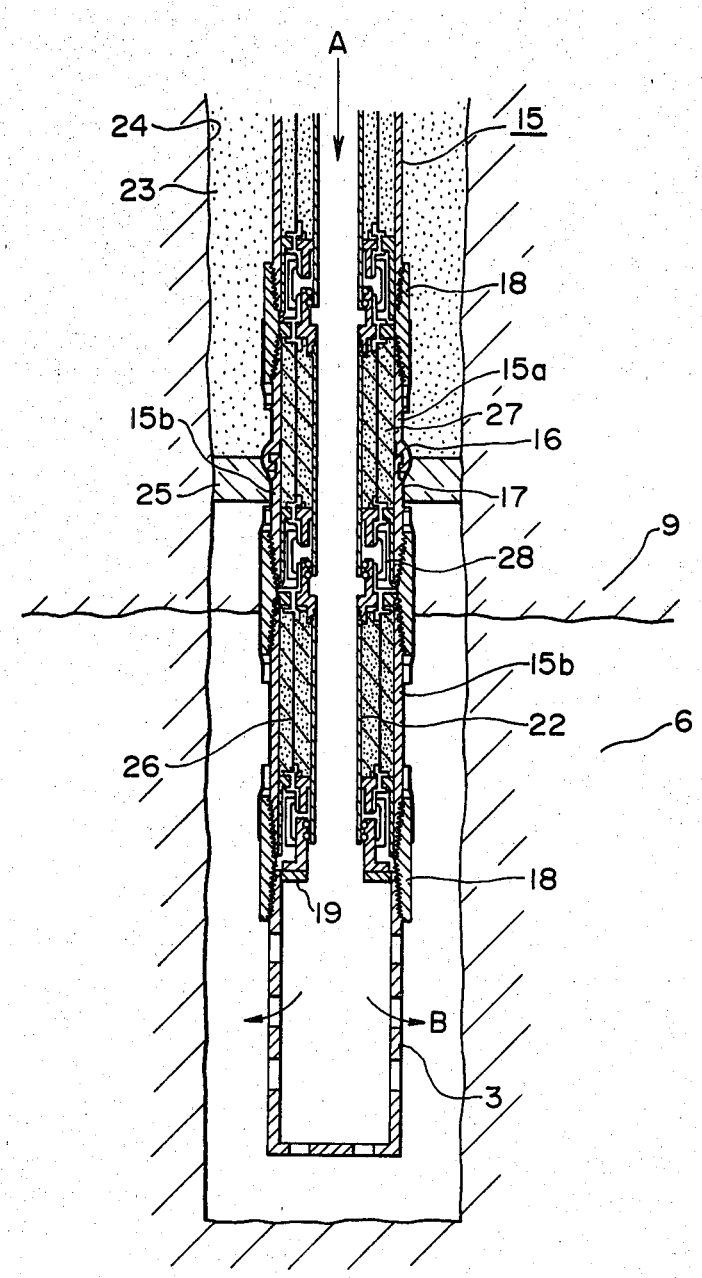
Figure 7:
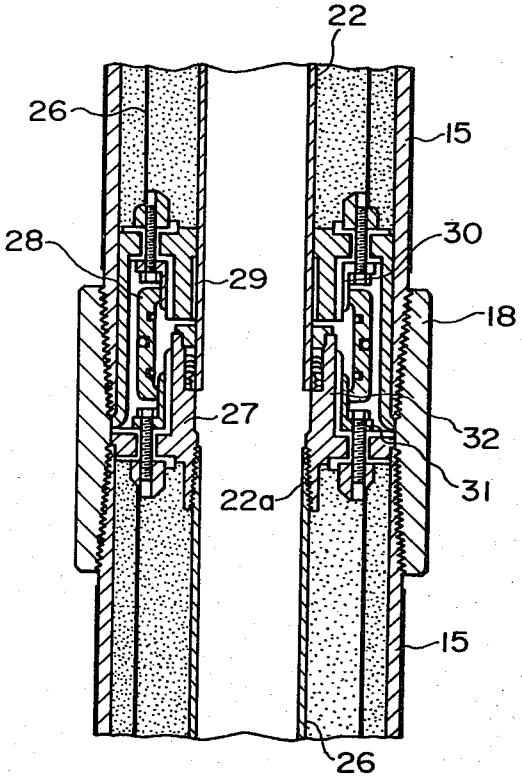
Figure 6:
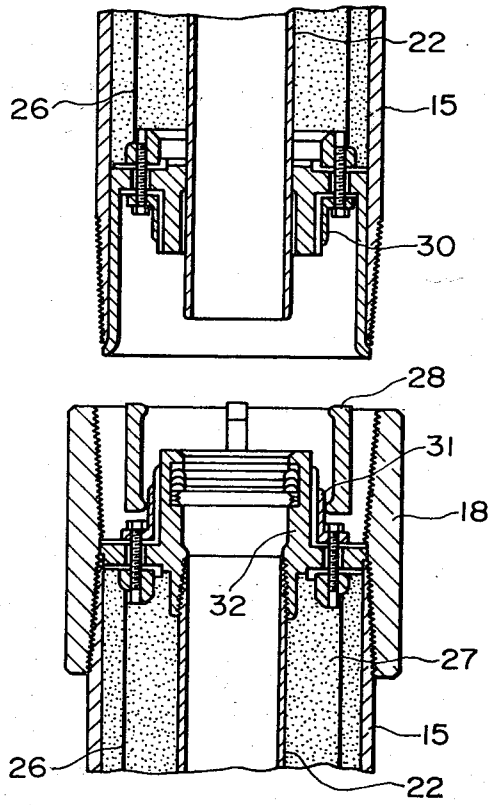

Another example of an electrode unit of the invention is shown in FIGS. 5 through 7. The electrode unit is superior to one shown in FIG. 4 in that the pipes or the pipes and the electrode can be more readily connected to one another. FIG. 5 is a sectional view of the electrode unit, FIG. 6 is an explanatory diagram for a description of the connection of the pipes, and FIG. 7 is an enlarged sectional view of the connecting point of the pipes.

In these figures, reference numeral 28 designates a connector for connecting electrical conductors 26. In the connector 28, a plurality of contactors are arranged in the form of a cylinder in such a manner as to be movable radially. The connector is brought into contact with ring-shaped connecting terminals 30 and 31 under a predetermined contact pressure. The connecting terminals 30 and 31 are arranged on a water pipe coupling 32 coaxially with the main conduit pipe assembly 15. The components 28 through 31 form a connecting member.

FIG. 6 shows the main conduit pipe assembly 15 prior to connection to a coupling 18. The main conduit pipe assembly 15 is threaded at one end. The threaded end is screwed into the coupling 18 as shown in FIG. 7. In this operation, the corresponding water pipes 22 and the electrical conductors are connected.

Figure 8:
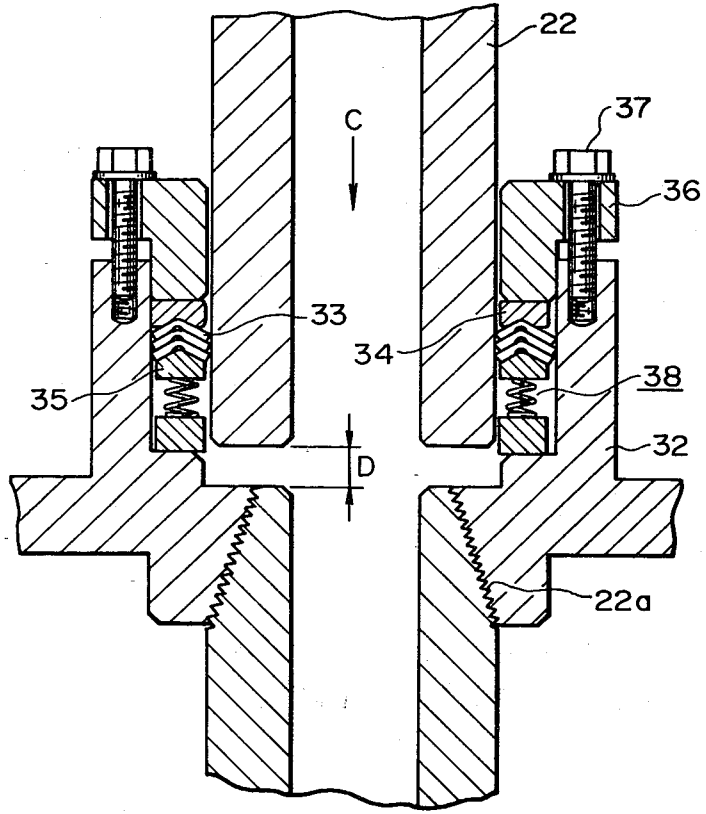
FIG. 8 is a cross-sectional view of a coupling which may be utilized with the embodiments of FIGS. 5–7 for joining adjacent water pipes.

Connection of the water pipe coupling 32 and the water pipe will be described with reference to FIG. 8 which is a sectional view showing a water pipe sealingly connecting device in detail. In FIG. 8, reference character 22*a* designates a thread which is cut at one end of the water pipe 22. The threaded end of the water pipe is screwed into the water pipe coupling 32. Further in FIG. 8, reference numeral 33 designates a lip type V-packing, 34 a holding ring for the V-packing 33, 35 a prepressurizing member having an elastic structure which is provided to cause the V-packing 33 to apply a predetermined planar pressure to the outer contact surface of the water pipe 22, 36 a metal retainer for preventing the V-packing 33 from being dislodged by the internal pressure of the water pipe 22, and 37 bolts for tightening the metal retainer to the water pipe coupling 32.

The V-packing 33 is so designed that, when an internal pressure is provided in the water pipe 22, the planar pressure acting on the outer contact surface of the water pipe 22 is increased according to the internal pressure to thereby prevent the leakage of fluid from the water pipe 22. The V-packing 33 is further designed so that, when the water pipe 22 is moved axially, it slides along the outer contact surface of the water pipe 22 thus maintaining the sealing function at all times. The above-described components 32 through 37 form a sealing device 38.

With the electrode unit as shown in FIGS. 6 through 8 assembled as shown in FIG. 5, the main conduit pipe assembly 15 is set close to the coupling 18, and then the assembly 15 is screwed into the coupling 18. In this operation, the lower end portion of the water pipe 22 is automatically inserted into the V-packing 33 so that the former is water-tightly connected to the latter. When the water pipe 22 thermally expands in the direction of the arrow C in FIG. 8, the contact surface of the V-packing 33 slides along the outer wall of the water pipe 22 so that the water pipe 22 is maintained in a water-tight relation to the V-packing 33. The thermal expansion of the water pipe 22 is absorbed by a clearance D shown in FIG. 8.

Figure 10:
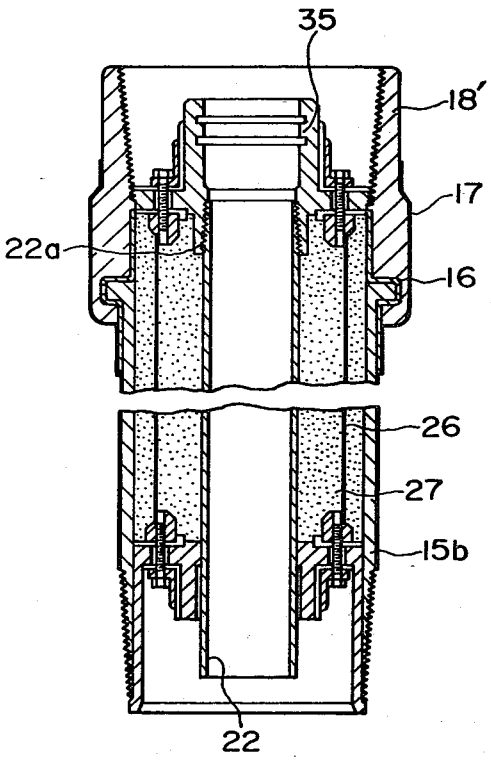
FIGS. 9 and 10 are cross-sectional views of yet another embodiment of an electrode unit of the invention.
Figure 9:
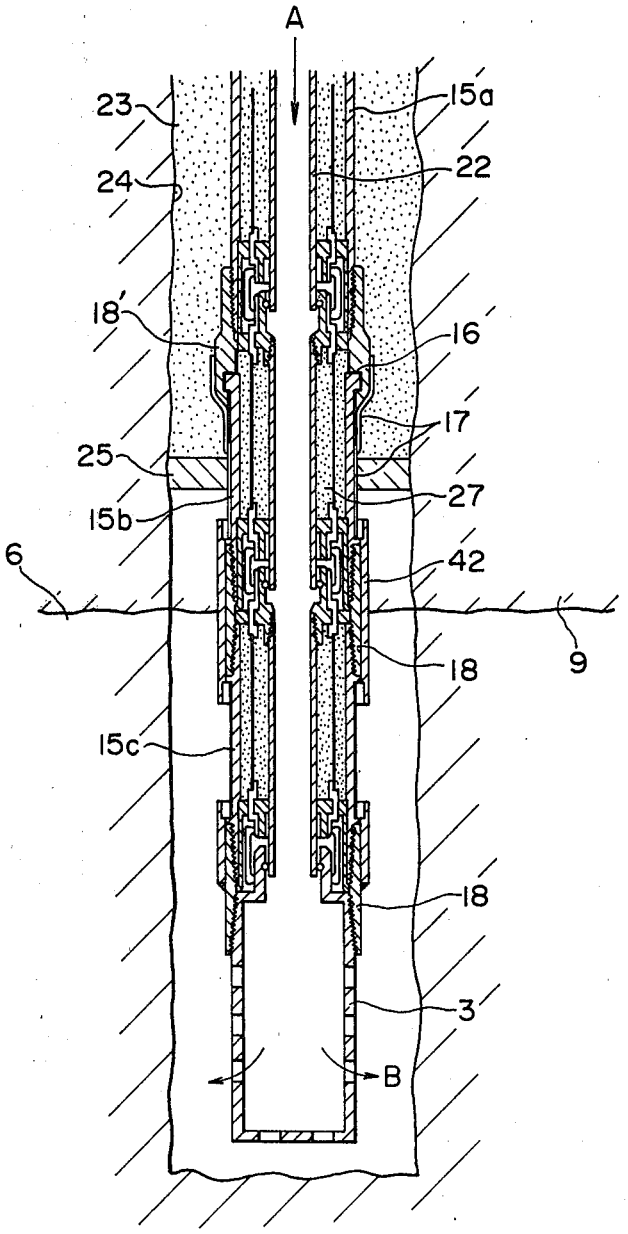

FIGS. 9 and 10 are cross-sectional views showing another example of the present invention. In FIGS. 9 and 10, parts that are common to those shown in FIG. 5 bear the same reference numerals. In this embodiment, the first conduit pipe 15*a* and the second conduit pipe 15*b* are coupled through a first coupling 18′, which is different in configuration from the coupling 18 shown in FIG. 5. As is clear from FIG. 10, the second conduit pipe 15*b* is connected to the first coupling 18′ through an insulator 16 which serves as an insulating material in an axial direction of the main conduit pipe assembly 15. Further, a part of the outer periphery of the coupling 18′ and a part of the outer periphery of the second conduit pipe 15*b* are converted with an insulating material 17. The second conduit pipe 15*b* and a third conduit pipe 15*c* are coupled by a coupling 18 with the insulating material 17 as shown in FIG. 5. The third conduit pipe 15*c* is coupled to the electrode 3 through a coupling 18 the outer periphery of which is not converted with the insulating material. In the example of FIG. 9, the insulating material 17 of the second coupling 18 may be replaced by an insulating cover 42 shown in FIG. 11.

Figure 11:
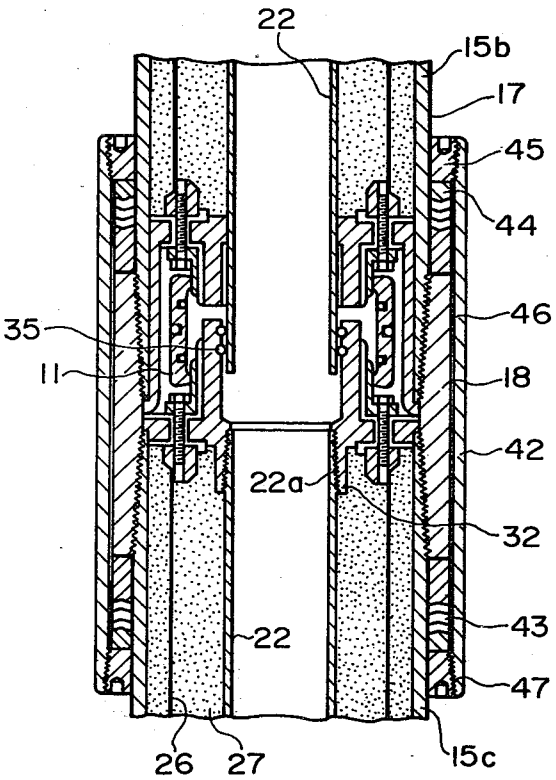
FIG. 11 shows the V-shaped packing and insulation between adjacent pipe members.

In the embodiment of the invention shown in FIG. 11, reference numeral 43 designates a lip type V-shaped packing, 44a holder for holding the V-shaped packing, 45 a pressing member for fixing the V-shaped packing 43 with pressure, and 46 a sleeve member for insulating the coupling 18. An inner periphery of the V-shaped packing 43 is fitted against an outer periphery of the insulating material 17. The insulating material 17, V-shaped packing 43 and the sleeve member 46 serves as an electrical insulator. Reference numeral 47 designates a protective sleeve.

Figure 13:
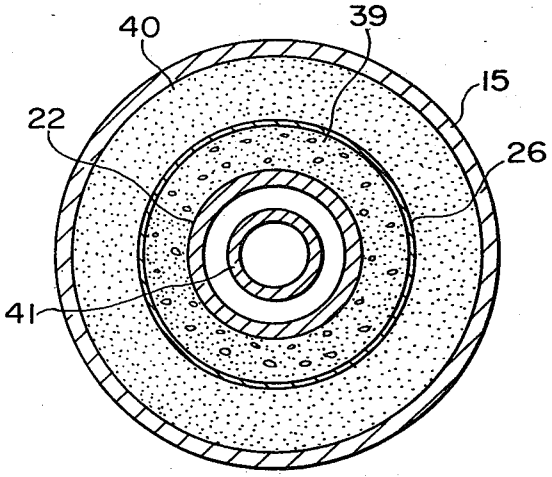
FIGS. 12 and 13 are corss-sectional views showing an embodiment of the invention employing a second water pipe with FIG. 13 being taken at 90° with respect to the view of FIG. 11.
Figure 12:
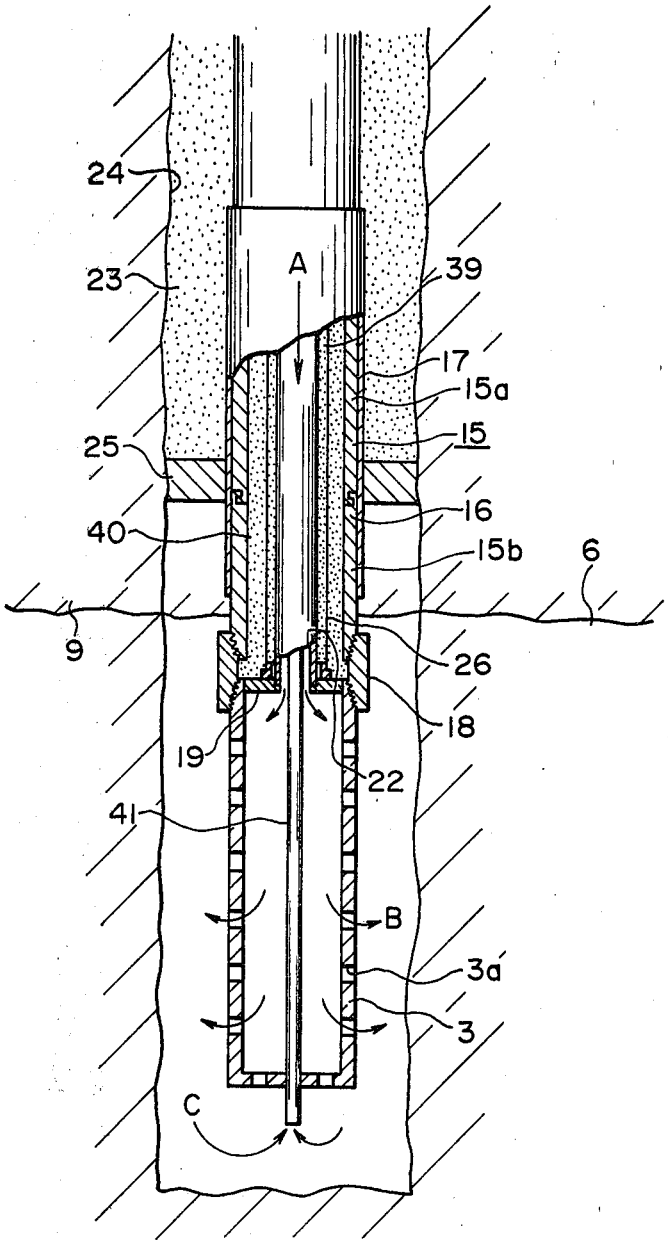

In the examples shown in FIGS. 4 and 5, the gap between the inner wall of the main conduit pipe assembly 15 and the water pipe 22 is fully filled with the solid heat insulating material 27. However, as shown in FIGS. 12 and 13, the gap between the electrical conductor 26 and the water pipe 22 may be filled with a thermally conductive but electrically insulating material 39 which electrically insulates the electrical conductor 26 from the water pipe and conducts the heat which is generated during the application of current to the water pipe 22. The gap between the electrical conductor 26 and the main conduit pipe assembly 15 is filled with a heat insulating material 40 so as to minimize the heat flow which otherwise may pass from the water pipe 22 through the main conduit pipe assembly 15 into the oil sand upper layer 9.

In FIGS. 12 and 13, a second water pipe 41 is provided extending through the water pipe 22 and through the electrode 3. Brine is passed through the water pipe 22 in the direction of the arrow A. The brine flows in the directions of the arrows B and C and returns to a brine tank (not shown) on the ground wherein it is cooled. By circulating the brine through the above-described brine circulating circuit, the electrical conductor 26 and the electrode 3 are cooled so that they are protected from overheating and burning.

In the above-described embodiment, the electrical conductor 26 is cylindrical. However, in order to prevent the occurrence of damage to the electrical conductor due to the difference in thermal expansion coefficients between the electrical conductor and the main conduit pipe assembly 15, a cylindrical electrical conductor which is made of a metal net material which is stretchable in the axial direction may be employed.

As is apparent from above description, according to the invention, the water pipe, the electrical conductor and the main conduit pipe assembly are arranged coaxially. With this arrangement, the clearance between the water pipe and the main conduit pipe assembly is larger than that of the conventional electrode unit. Furthermore, solid heat insulating material, preferably powdered heat insulating material, is employed in the electrode unit of the invention. The electrode unit has a considerably high thermal efficiency. In addition, according to the invention, it is unnecessary to cool the heat insulating material itself. Furthermore, the electrode unit of the invention is so designed that the electrical conductor or the water pipe is protected from damage due to the difference in thermal expansion coefficients between the main conduit pipe assembly and the electrical conductor or the water pipe. Since no magnetic substance, such as the water pipe, is close to the electrical conductor, the impedance of the assembly is much lower than that of the conventional electrode unit. Thus, the electrode unit of the invention is effective in reducing the loss of power transmission.

Furthermore, assembly of the electrode unit of the invention can be readily achieved because, when the main conduit pipe assemblies are connected to one another, the water pipes are simultaneously connected to one another. As the V-packing is provided with a pre-pressurizing member having an elastic structure, it is unnecessary to additionally tighten the electrode unit at a later time in order to prevent leakage of liquid which otherwise could occur upon deformation of the V-packing which may in time occur.

Thus, the electrical heating electrode unit of the invention has a low power transmission loss, high thermal efficiency, and excellent durability, and moreover can be readily assembled.

What is claimed is:

1. An electrode unit for electrically heating underground hydrocarbon deposits comprising: a main conduit pipe; a cylindrical water pipe disposed within and coaxially to said main conduit pipe; a cylindrical electrical conductor disposed between said water pipe and said main conduit pipe; and a solid heat insulating material disposed in spaces between said water pipe and said main conduit pipe.

2. The electrode unit of claim 1 wherein said solid insulating material is a material selected from the group consisting of glass wool, molded material, and inorganic solid powder.

3. The electrode unit of claim 1 wherein said electrical conductor is made of a conductive metal mesh.

4. The electrode unit of claim 1 further comprising first and second connectors for connecting electrical conductors between adjacent electrode units, said first and second connectors being disposed at the opposite ends of said electrode unit, said first connector comprising a ring-shaped connecting terminal disposed coaxially between said water pipe and said main conduit pipe, and said second connector comprising a plurality of contactors arranged cylindrically and movable radially adapted for making contact with a ring-shaped connecting terminal of an adjacent electrode unit while providing a predetermined contact pressure, said contact is being coupled to said electrical conductor through a second ring-shaped connecting terminal arranged coaxially with said water pipe at said second end.

5. The electrode unit of claim 4 wherein ends of said main conduit pipe and said water pipe are provided with threads adapted to connect with an adjacent electrode unit, wherein said contactors make electrical contact with said first-mentioned ring-shaped connecting terminal and said water pipe connects with an adjacent water pipe when said main conduit pipe is joined to an adjacent main conduit pipe.

6. The electrode unit of claim 5 further comprising a water pipe coupling provided at one end of said water pipe, said water pipe coupling comprising a water pipe coupling body member having a threaded portion adapted to be threadingly engaged with threads cut in said water pipe, a V-type lip packing disposed between a cylindrical portion of said water pipe coupling body member and an adjacent water pipe, a metal retainer coupled through bolts to said cylindrical portion of said water pipe coupling body member, a holding ring disposed between said metal retainer and said V-type lip packing, and a pre-pressing member disposed between a flange of said water pipe coupling body member and said V-type lip packing for urging said V-type lip packing into engagement with said holding ring.

7. The electrode unit of claim 1 further comprising a coupling for joining adjacent electrode units coupled to one end of said electrode unit, said coupling comprising an insulator disposed around one end of said main conduit pipe, a coupling body having one end coaxially joined to said end of said main conduit pipe through said insulator and said connector body having a second end having threads formed on an inner surface thereof, and a layer of insulating material covering a portion of said connector body and at least a portion of an outer surface of said main conduit pipe.

8. The electrode unit of claim 7 further comprising an insulating cover disposed around said second end of said main conduit pipe around said coupling body, a lip-type V-shaped packing having an inner surface disposed against said insulating layer of insulating material at said second end of said main conduit pipe, and a protective sleeve disposed between said lip-type V-shaped packing and an end of said insulating cover.

9. The electrode unit of claim 1 further comprising a contacting electrode having a plurality of apertures formed therein adapted to be coupled to a lower electrode unit in an assembly of electrode units.

10. The electrode unit of claim 9 further comprising a second water pipe disposed inside of and coaxially with said first-mentioned water pipe, said second water pipe extending coaxially through said contacting electrode.

11. The electrode unit of claim 1 wherein said solid insulating material comprises a thermally conductive but electrically insulating material disposed in space between said water pipe and said cylindrical electrical conductor and a heat insulating material disposed in space between said cylindrical electrical conductor and said main conduit pipe.

* * * * *